US007439834B2

(12) United States Patent
Mochizuki et al.

(10) Patent No.: US 7,439,834 B2
(45) Date of Patent: Oct. 21, 2008

(54) ELECTROMAGNETIC RELAY

(75) Inventors: Naoya Mochizuki, Tokyo (JP); Hideaki Takeda, Misato (JP)

(73) Assignee: Uchiya Thermostat Co., Ltd., Saitama-ken (JP)

( * ) Notice: Subject to any disclaimer, the term of this patent is extended or adjusted under 35 U.S.C. 154(b) by 149 days.

(21) Appl. No.: 11/332,915

(22) Filed: Jan. 17, 2006

(65) Prior Publication Data

US 2007/0008053 A1 Jan. 11, 2007

(30) Foreign Application Priority Data

Jul. 11, 2005 (JP) ..... 2005-201022

(51) Int. Cl.
*H01H 51/22* (2006.01)

(52) U.S. Cl. ..... 335/78; 335/128

(58) Field of Classification Search ..... 335/78–86, 335/124, 128–131, 202
See application file for complete search history.

(56) References Cited

U.S. PATENT DOCUMENTS 5,844,456 A 12/1998 Mader ..... 335/78
6,611,184 B2 8/2003 Hoffmann ..... 335/78
7,061,350 B2 * 6/2006 Schneider et al. ..... 335/78
2005/0264388 A1 12/2005 Chida et al. ..... 335/128

FOREIGN PATENT DOCUMENTS

JP 10-125202 5/1998
JP 2001-093393 4/2001

* cited by examiner

*Primary Examiner*—Lincoln Donovan
*Assistant Examiner*—Bernard Rojas
(74) *Attorney, Agent, or Firm*—Fattibene and Fattibene; Paul A. Fattibene; Arthur T. Fattibene

(57) ABSTRACT

To reduce the internal resistance of small electromagnetic relays of a one-circuit three-contact gap type in order to make it possible to allow large electric currents and at the same time to improve the connection between the fixed contacts and the moveable contacts. Fixed contacts on the fixed terminals are positioned at each apex of an approximate triangle on the upper surface of the insulation base. Moveable contacts are installed on the lower surface of the moveable plate, and are respectively placed in a position which corresponds to each of the fixed contacts. The moveable plate is fastened to the moveable spring whose both ends are held onto the sides of the insulation base, and moves at a specified distance from the fixed contacts due to the pressure of the moveable spring. The construction results in the movable contacts contacting their corresponding fixed contacts at the three positions with uniform contact strength.

6 Claims, 12 Drawing Sheets

ELECTROMAGNETIC RELAY

BACKGROUND OF THE INVENTION

1. Field of the Invention

This invention is concerning a new type of electromagnetic relay. Especially, it is concerning small electromagnetic relays whose internal resistance on the contact circuit side of an electromagnetic relay with the one-circuit three-contact gap has been reduced as much as possible and for which necessary improvements have been made to be able to allow the flow of large electric currents.

2. Description of the Related Art

First, we would like to explain about a conventional small electromagnetic relay 1 in accordance with FIG. 12. FIG. 12 is a vertical side view showing the outline of electromagnetic relay 1. The electromagnetic relay 1 shown therein consists of yoke 3 vertically installed on insulation base 2, which was mold-produced, Iron Core 4 which was fastened onto the Yoke 3, Coil 5, which was wound around a bobbin with iron core 4 being placed in the center, armature 6, which was installed to be able to revolve freely with the upper end of the armature 6 as the revolution supporting point, insulation card 7, which makes a piston move back and forth following the revolutionary move of the armature 6, moveable contact plate 8, whose lower end is fastened to the insulation base 2 and which makes revolutionary move back and forth due to the back and forth move of the insulation card 7 with the lower end as the revolution supporting point, moveable contact 9, which was installed on the moveable contact 8's upper end's outside surface, fixed contact plate 10, which was installed in front of and in parallel with the moveable contact plate 8, to contact with the front end of insulation card 7 and whose lowest end is fastened to the aforementioned insulation base 2 and which moves back and forth with that lowest end as the move supporting point, moveable contact 9, which was built on the outside of the upper end of moveable plate 8, fixed plate 10, which was build in front of and in parallel with moveable plate 8, fixed contact 11, which was installed on the backside of the upper end of fixed contact plate 10, facing the moveable contact 9, and cap 12, which accommodates all of the above.

This electromagnetic relay 1 is structured so that the iron core 4 attracts or releases one end of the armature 6 by means of electric on or off onto the coil 5, causing the armature 6 to revolve with the revolution supporting point of the armature 6 as the center, causing the lower end of the armature 6 to move the insulation card 7 back and forth, and that the back and forth move of the insulation card 7 causes the moveable contact plate 8 also to make revolutionary move back and forth with its lower end as the revolution supporting point, causing the moveable contact 9 installed on the moveable contact plate 8 to contact or leave the fixed contact 11 to make an open or close action between the moveable contact 9 and the fixed contact 11.

Meanwhile, as the moveable contact plate 8 has the structure of a cantilever spring whose lower end is fastened to the insulation base 2, this type of electromagnetic relays are used where required electric current capacity is not so large. (For example, refer to Patent Literature 1 to 3: Japanese Patent Application Laid-open Nos. H6-23166, H10-125202 and 2001-93393, respectively.)

In the case of conventional electromagnetic relays like this, the moveable contact plate 8 needs to be structured with a spring plate. For this reason, you cannot reduce the internal resistance on the contact circuit side, and if you are to use a moveable contact plate which has contact with the aim of reducing the internal resistance, you will have to use a thicker plate, a stronger spring and heavier moveable contact 9, which may cause such relays to malfunction when they receive some kind of shocks.

SUMMARY OF THE INVENTION

A technological challenge arises to reduce the internal resistance as much as possible on the contact circuit side and flow large currents as well as to improve the contact function of small electromagnetic relays with one-circuit 3-contact gap, and the objective of this invention is to resolve this challenge.

This invention has been offered to attain the above objective, and in the electromagnetic relay which has an electromagnetic drive section, which consists of a coil, iron core, yoke and armature, and fixed contacts and moveable contacts, which open or close in response to the drive action of the electromagnetic drive portion, each of the fixed contacts is made respectively on fixed terminal No. 1, No. 2 and No. 3, which are positioned on the surface of the isolation base as if they were joined to the isolation base and is positioned at the apex of the approximate triangle on the upper surface of the isolation base.

Meanwhile, each of the moveable contacts is positioned on the lower surface of the moveable plate and at a position corresponding to each of the fixed contacts, and the moveable plate is fastened to a moveable spring with its both ends being fastened to the edges of right and left sides of the isolation base, and is structured so that it will move at a specified distance from the fixed contacts by the pressure of the moveable spring, and on the upper surface of the moveable plate, an elastic plate, whose one end is fastened to a height made on the isolation base, is installed, and the elastic plate has a step section in its center, and the step section is installed in a way that it will contact the center of the approximate triangle connecting the three contacts' contact positions, and there are both sides' side sections which contact the end portion of the armature, and the drive action of the armature lowers the moveable plate against the pressure of the moveable spring, causing deflection to the elastic plate, thus providing a type of electromagnetic relay which is structured so that each contact's contact strength will be maintained uniformly at the three points where each fixed contact and its corresponding moveable contact will contact.

In the case of this invention, each of the three fixed contacts is installed on each of fixed terminal No. 1, No. 2 and No. 3, which are installed as if they were joined to the upper surface of the isolation base, at each apex of an approximate triangle, and each of the three moveable contacts is installed in a position corresponding to each of the fixed contacts, thus creating a structure in which each fixed contact and each moveable contact will be connected elastically and simultaneously through the drive action of the armature, thus creating what is called an electromagnetic relay with one-circuit three-contact gap.

And in the case of an electromagnetic relay with one-circuit three-contact gap, the armature's drive action causes the T-shaped elastic plate, which has a straight line section and side sections on both sides, to lower the moveable plate against the pressure of the moveable spring which fastens the moveable plate is fastened by approx. T-shaped elastic plate which has a linear portion and side portions on both sides, thus causing each moveable contact installed on the moveable plate to connect to its corresponding fixed contact elastically and simultaneously to provide the function of an electromagnetic relay.

And each of the fixed contacts is installed on the upper surface of each of the fixed terminals installed like a flat panel as if it were joined to the upper surface of the insulation base, and the moveable contacts connecting to the fixed contacts are also installed on the lower surface of the flat panel-like moveable plate, and these fixed contacts and moveable contacts can promptly approach each other for connection, so as the moving stroke of the moveable plate can be made small, it is possible to make the moveable spring, which pushes the moveable plate upwards, with a thin plate. And as it is also possible to make the aforementioned elastic plate small and thin, this invention for electromagnetic relays with one-circuit three-contact gap structure makes it possible to reduce the internal resistance and therefore to flow large electric currents and also to ensure the durability and the contact stability between the fixed contacts and the moveable contacts.

And as it is possible to hold the moveable spring of both-end supported type by bending both ends perpendicularly downwards and inserting them into the slits made in the upright installation section positioned the left-right side portions of the insulation base, you can easily assemble this type of electromagnetic relays. By securing space for bending around this section for bending, you can secure sufficient space, reduce load onto the moveable spring and increase the durability and reliability of the moveable spring.

If you mount thick fixed terminals in a small relay in order to flow large electric currents, sufficient strength of the terminals and the isolation base supporting it will be required. But in the case of this invention, as the fixed terminals are extended along the upper surface of the insulation base and installed on it as if they were joined onto the upper surface of the insulation base, the fixed terminals reinforce the strength of the plastic insulation base and the fastening strength of the fixed terminals themselves can also be secured.

What should be especially noted about this invention is that as aforementioned, as the elastic plate is formed approximately like the letter T in top view, the front end portion of the straight line section of T has a step section, and the side sections on both sides, left and right, are installed just before the step section, the straight line section works to make the moveable contact in the center and the fixed contact in the center contact each other via the step section with the side sections on both sides working to make the left and right fixed contacts and the corresponding left and right moveable contacts contact each other. And the armature's drive action causes deflection onto the elastic plate to lower the moveable plate against the pressure of the moveable spring, thus making it possible to connect each of the fixed contacts with its corresponding moveable contact elastically and simultaneously, which causes the one-circuit three-contact electromagnetic relay to function very efficiently.

This invention, especially in a small electromagnetic relay, has realized the objective of reducing the internal electrical resistance on the contact circuit side as much as possible so as to be able to flow large electric currents efficiently by fastening three fixed terminals onto the insulation base, installing each fixed contact on the apex of an approximate triangle on each fixed terminal, installing the moveable plate which has a moveable contact at a position corresponding to each of fixed contacts, fastening each moveable plate to the moveable spring, whose both ends are supported by the insulation base, setting an approximately T-shaped elastic plate, whose one end is supported by a height made on the insulation base, thus producing a structure in which the contact circuit will open or close through the armature's drive of the elastic plate depending on the presence or absence of electric current flow to the coil.

DESCRIPTION OF THE PREFERRED EMBODIMENTS

Figure 1:
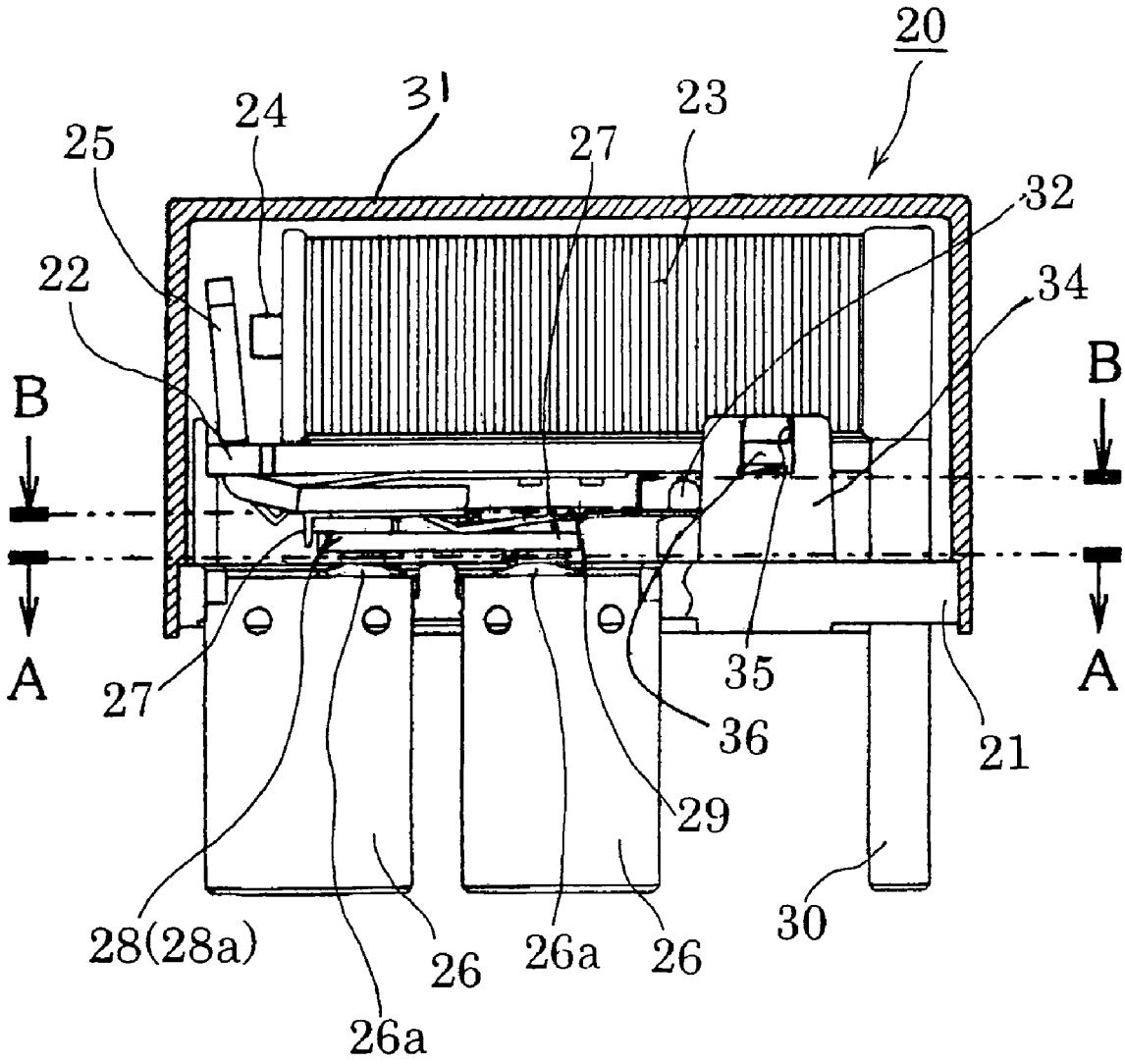
FIG. 1 is a vertical side view of an electromagnetic relay with one-circuit three-contact gap.

We would like to provide detailed explanations about a preferred embodiment of this invention by using FIG. 1 to FIG. 11. FIG. 1 shows an electromagnetic relay 20 of this invention. This electromagnetic relay 20 consists of a thick insulation base 21 like a flat panel, which is produced through a molding method, yoke 22, coil 23, iron core 24, armature 25, fixed terminals 26 fixed contacts 26*a*, which are respectively installed on fixed terminals 26, moveable springs 27, moveable plate 28, which is supported and fastened by moveable springs 27, moveable contacts 28*a*, which connect or disconnect with fixed contacts 26*a*, elastic plate 29, which elastically pressure-releases moveable springs 27, coil terminal 30 and cap 31. The electromagnetic relay 20 shown in FIG. 1 is an electromagnetic relay with one-circuit three-contact gap as schematically shown in the circuit diagram of FIG. 11.

The electromagnetic relay 20 is structured so that the armature 25 drives the moveable spring 27 via the elastic plate 29 depending on the presence or absence of electric current flow to the coil 23 in order to open or close the contact circuit by connecting or disconnecting the moveable contacts 28*a*, to the fixed contacts 26*a*.

As is shown in FIG. 1, the coil 23, which is wound around the bobbin, is installed in a way being supported by the yoke 22, and the armature 25 which uses the left-end of the yoke 22 as the pivoting or revolution supporting point, thus forming the electromagnetic drive block.

Meanwhile, as we explain later, the terminal side block consists of the fixed terminals 26 which are fastened onto the flat panel-like insulation base 21, the fixed contacts 26*a* which are installed on the fixed terminals 26 in a triangle shape, the moveable contacts 28 which are installed in a way corresponding to each of the fixed contacts 26*a*, and some other components.

Figure 2:
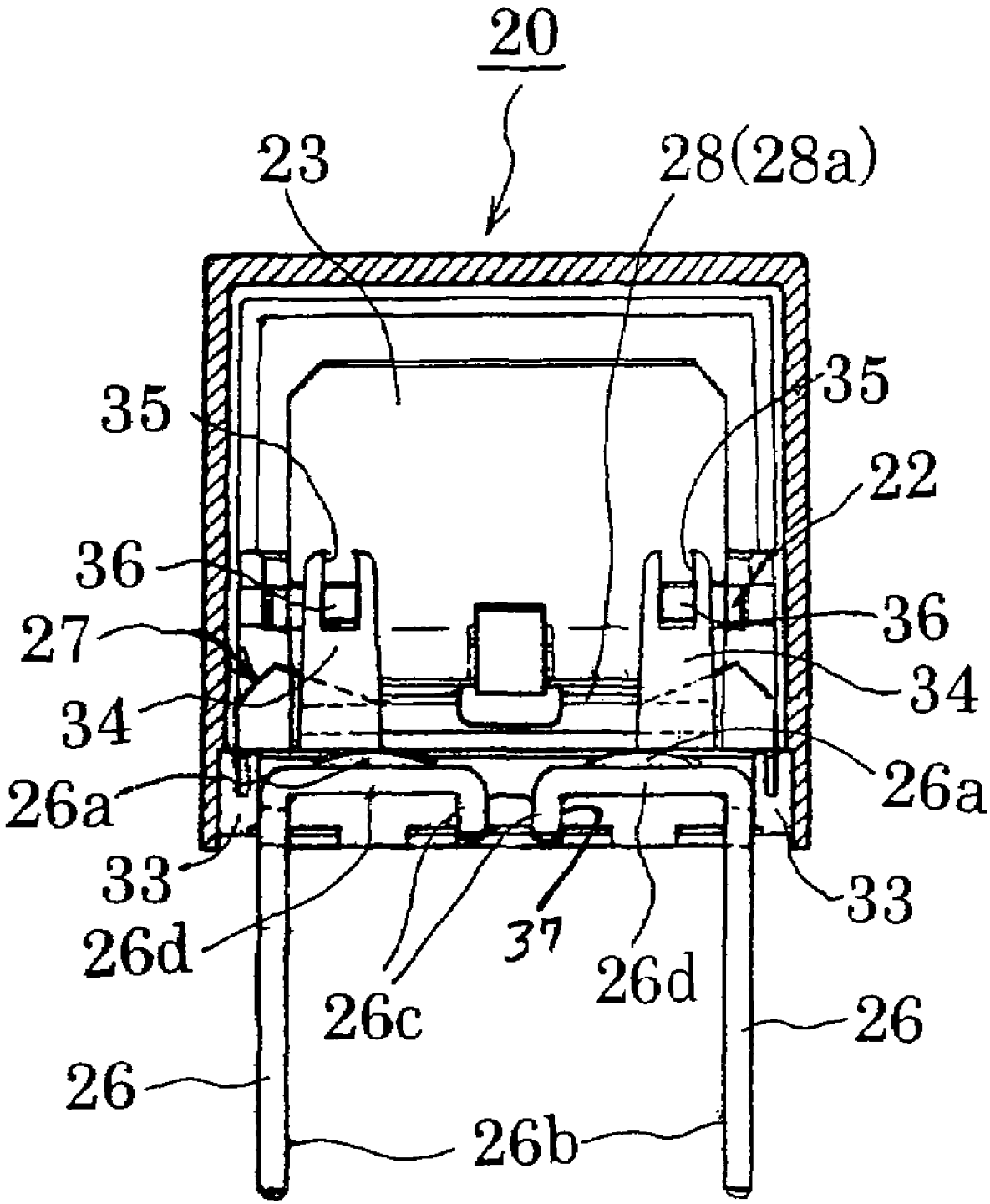
FIG. 2 is a front view of the left end of FIG. 1.
Figure 3:
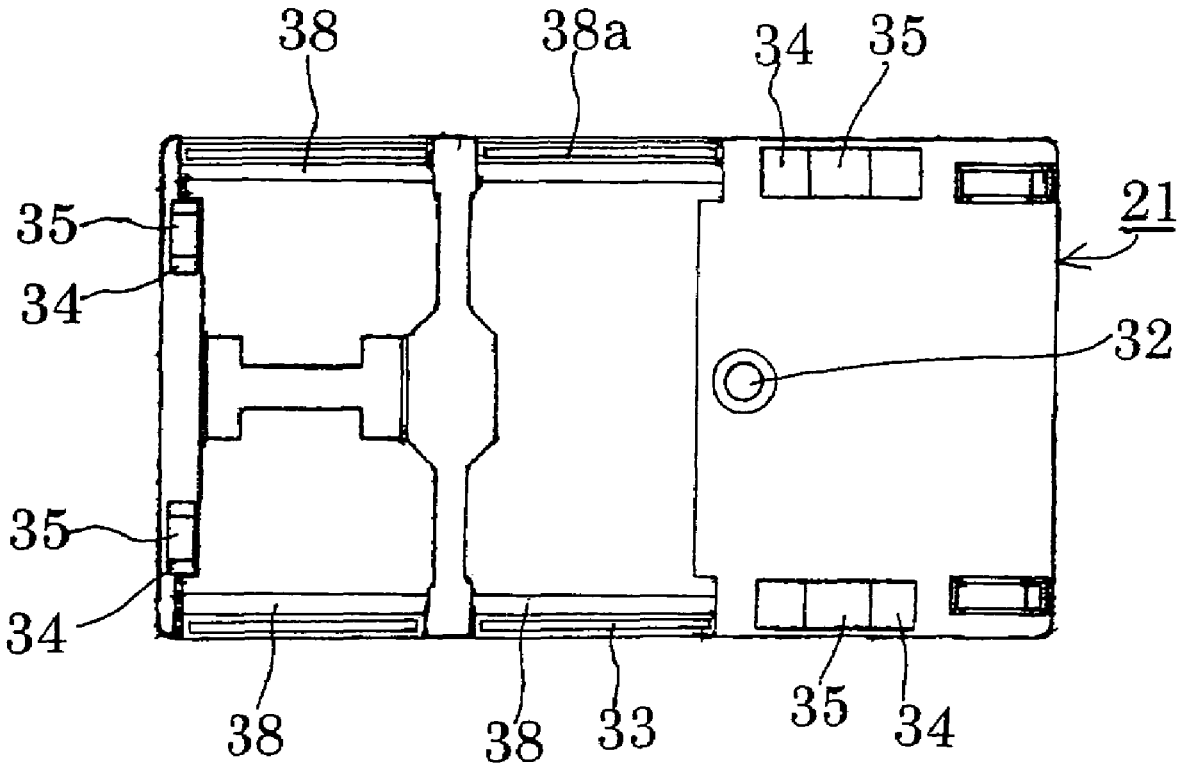
FIG. 3 is a top view of insulation base.
Figure 4:
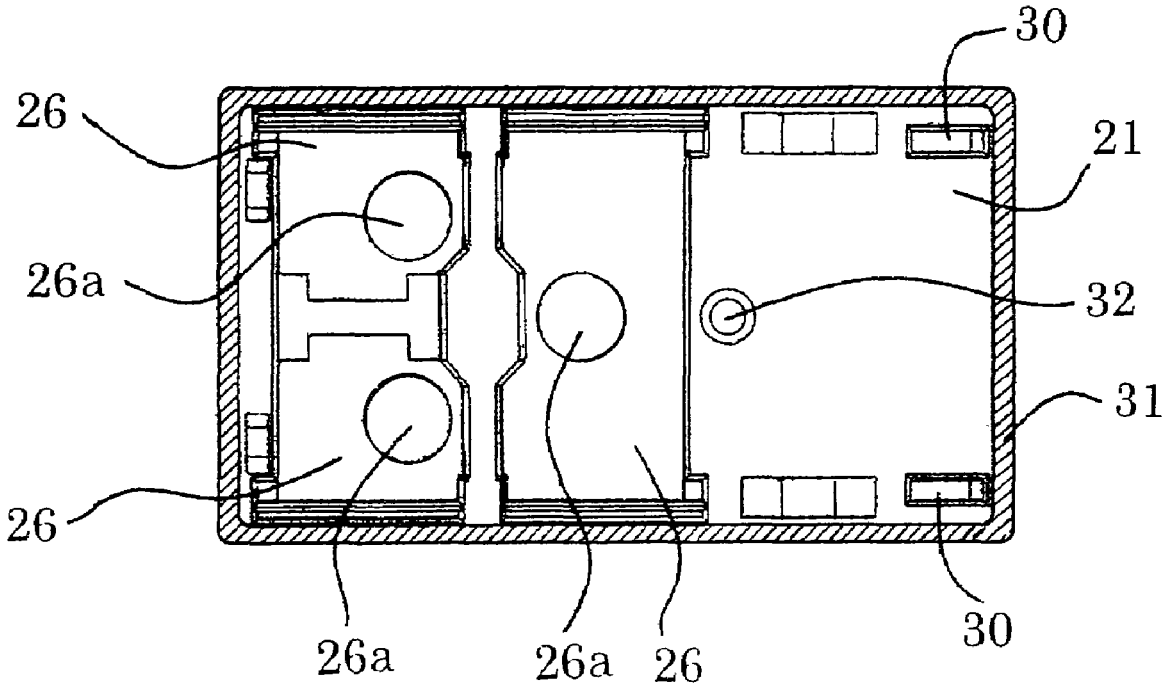
FIG. 4 is a cross section view taken along line A-A of FIG. 1.

As shown in FIG. 3 and FIG. 4, a height 32 is made near the center of the insulation base 21 of the terminal side block, and low upright mounting pieces are made on the edge of the insulation Base 21, and cubic pieces 34 are installed at various places, and small holes or slits 35 are made on the cubic pieces 34, and the heights 36, illustrated in FIGS. 1 and 2, which correspond to the small holes or slits 35, are made on the yoke 22 on the side of the electromagnetic drive block, and by joining the heights 36 to the small holes or slits 35, the electromagnetic drive block is installed very near the terminal side block as if it were overlying on the terminal side block.

Figure 5:
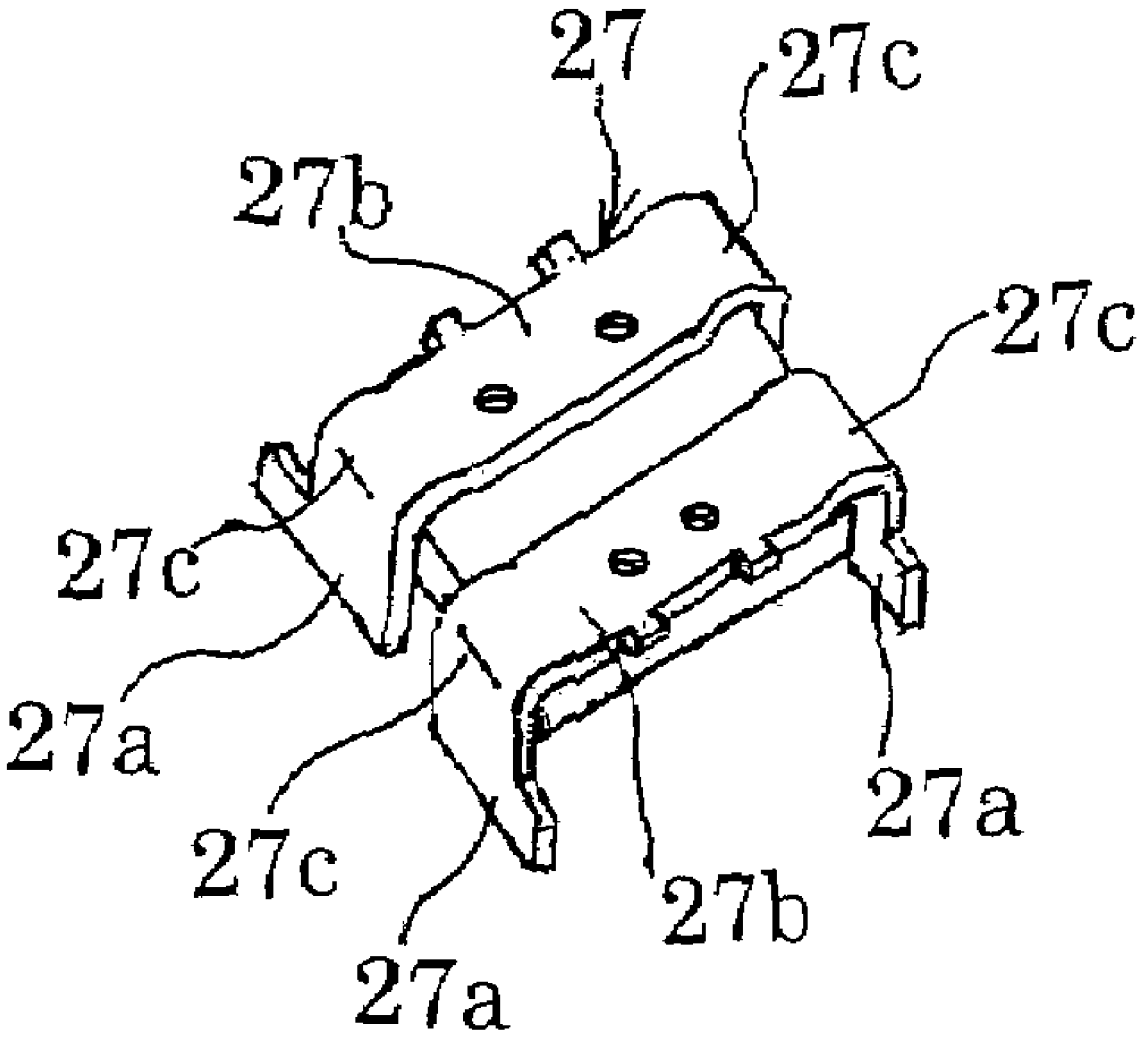
FIG. 5 is a perspective view of the moveable panel fastened to the moveable spring.
Figure 6:
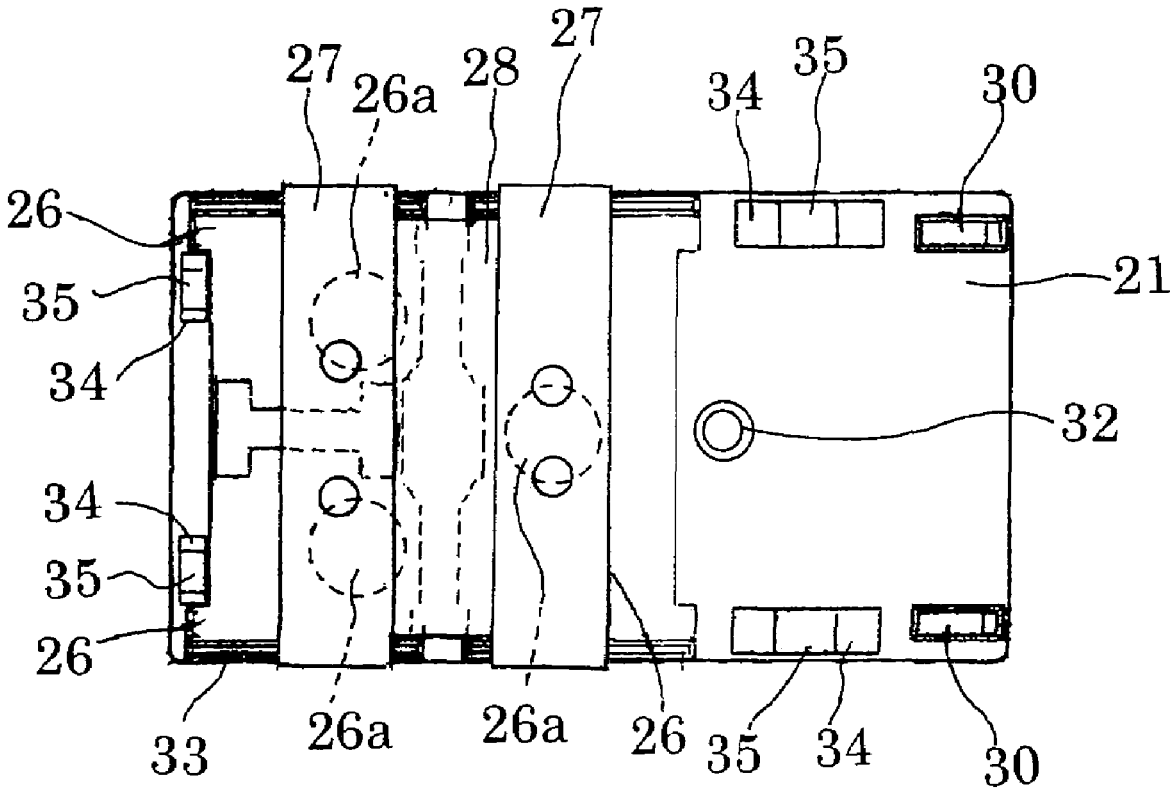
FIG. 6 is a cross section view taken along line B-B of FIG. 1.

And the moveable springs 27 are installed like the adverse of U with its both ends curbing downwards as shown in FIG. 2, and the curved sections 27*a*, illustrated in FIG. 5, are inserted into the slits made on the upper surface of mounting sections 33, illustrated in FIGS. 2 and 6, made on the right and right sides' edges of the insulation base 21 for fastening, and the flat sections 27*b*, illustrated in FIG. 5, of the moveable springs 27 are fastened to the upper surface of the moveable plate 28 by means of rivets, etc., and the moveable plate 28 is supported by the moveable springs 27 in a way of both ends being supported, and to add elasticity to the moveable springs 27, bulges 27*c*, illustrated in FIG. 5, are made on the upper angular sections of the curved sections 27*a* and in accordance with the action of the bulges 27*c*, the moveable springs 27, cause the moveable plate 28 to move at a specified distance from the fixed contacts 26*a*.

Of the fixed terminals 26, the fixed terminals 26, which are on the left side in FIG. 1 and are the front side in FIG. 2, are installed like the adverse of U-shape with the longer sides being called longer sides 26*b*, and with the shorter sides being called shorter sides 26*c*, and the shorter sides 26*c* are inserted into the central slits 37 which are made on the insulation base 21 as shown in FIG. 3 for fastening, and the flat sections 26*d* are joined onto the upper surface of the insulation base 21, and the longer sides 26*b* are inserted into the through holes 38, which are made through left and right sides of the insulation base 21 with the extra portions being extended to the outside of the insulation base 21.

And the other fixed contact 26*a* is installed like the adverse of U-shape, and its longer side 26*b* is inserted into the other through hole 38 which is made on the one side of the insulation base 21 as if it were installed to the backside of the fixed terminal 26 in front of it, and its shorter side 26*c* is inserted into the other through hole 38*a*, illustrated in FIG. 3, which is made on the other side of the insulation base 21, and the flat section 26*d* of the fixed terminal 26 on which the fixed contact 26*a* is made is fastened onto the insulation base 21 as if jointed onto it, and on each of the fixed terminals 26, the fixed contacts 26*a* are made at the apex of a triangle.

Figure 7:
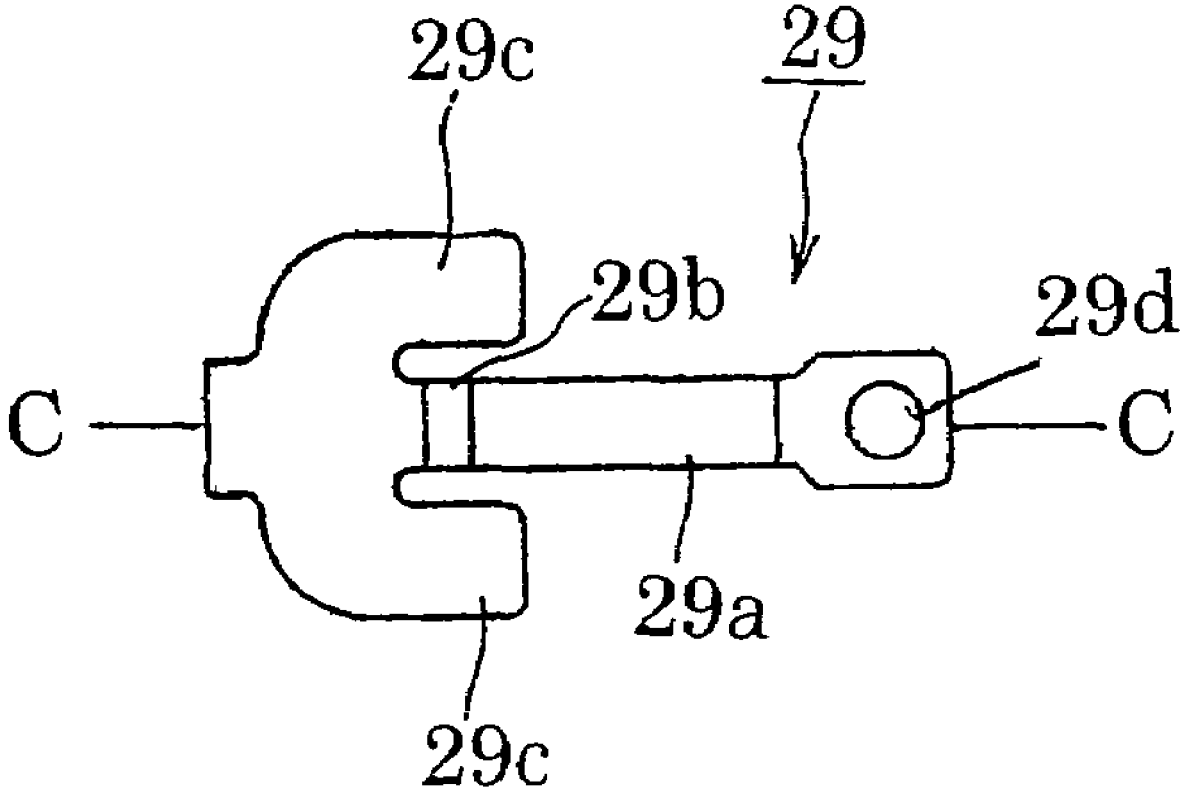
FIG. 7 is a top view of the elastic plate.
Figure 8:
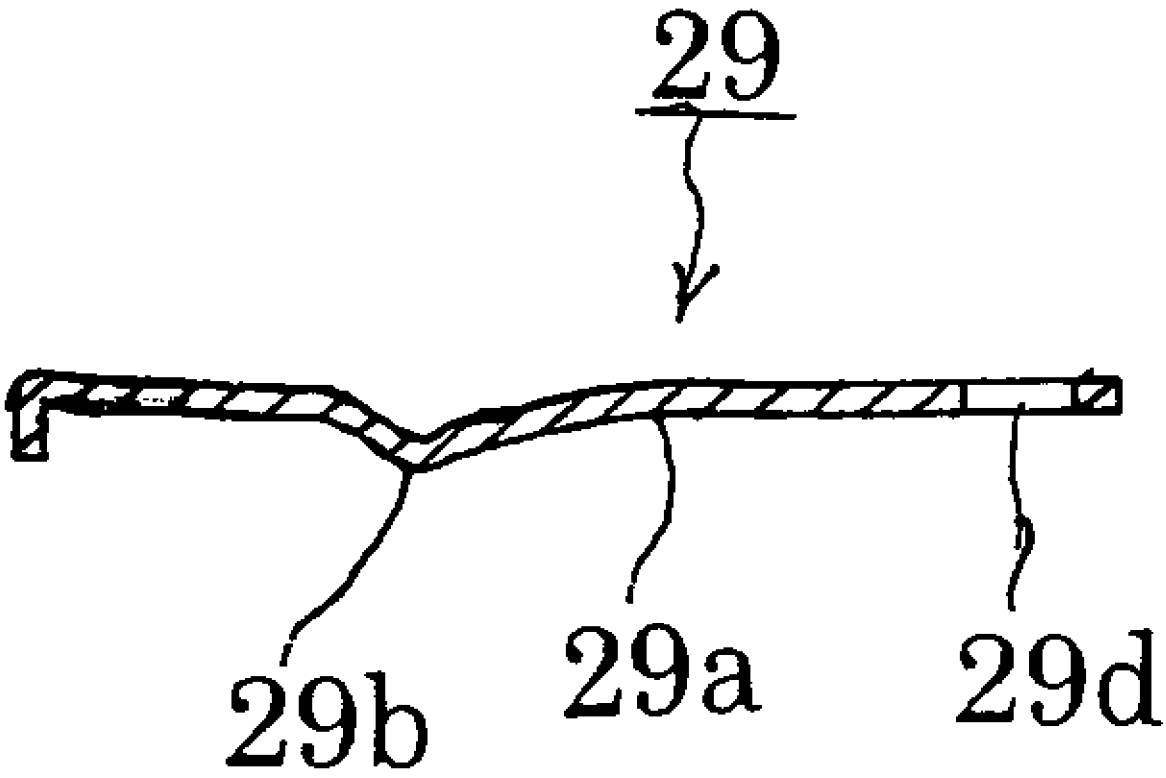
FIG. 8 is a cross section view taken along line C-C of FIG. 7.
Figure 9:
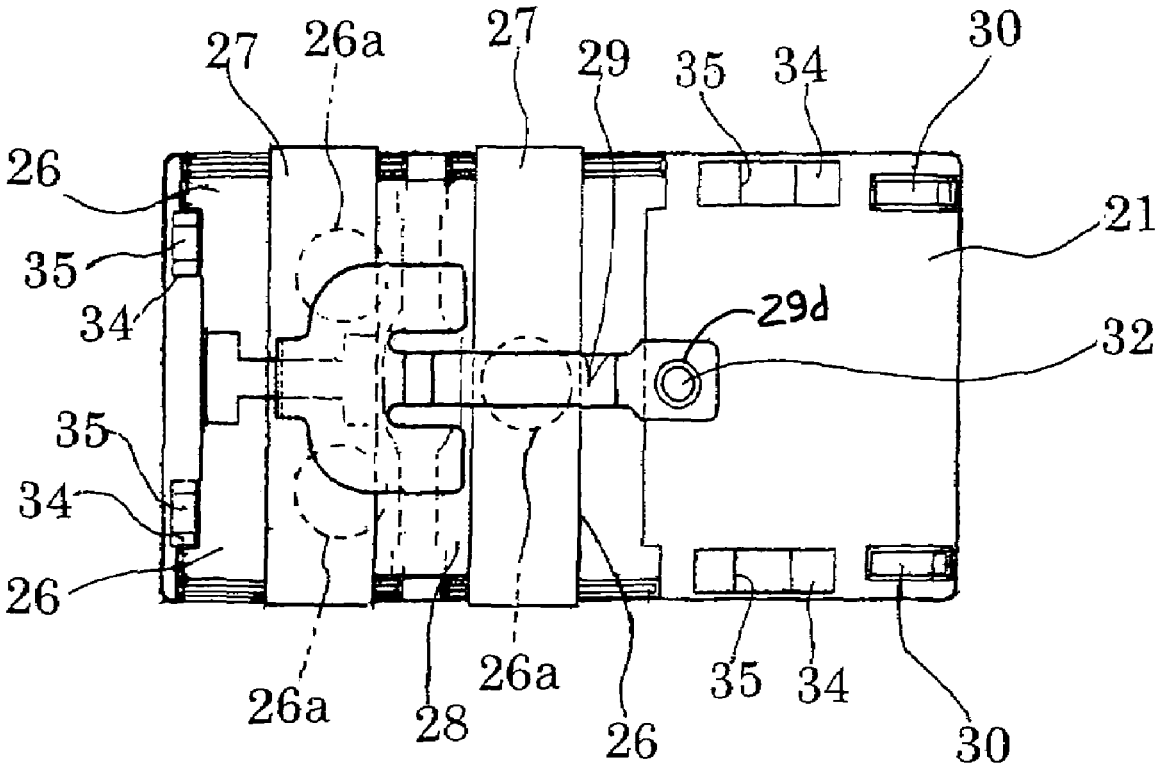
FIG. 9 is a top view showing the condition of setting the elastic plate on the upper surface of the moveable plate shown in FIG. 4.
Figure 10:
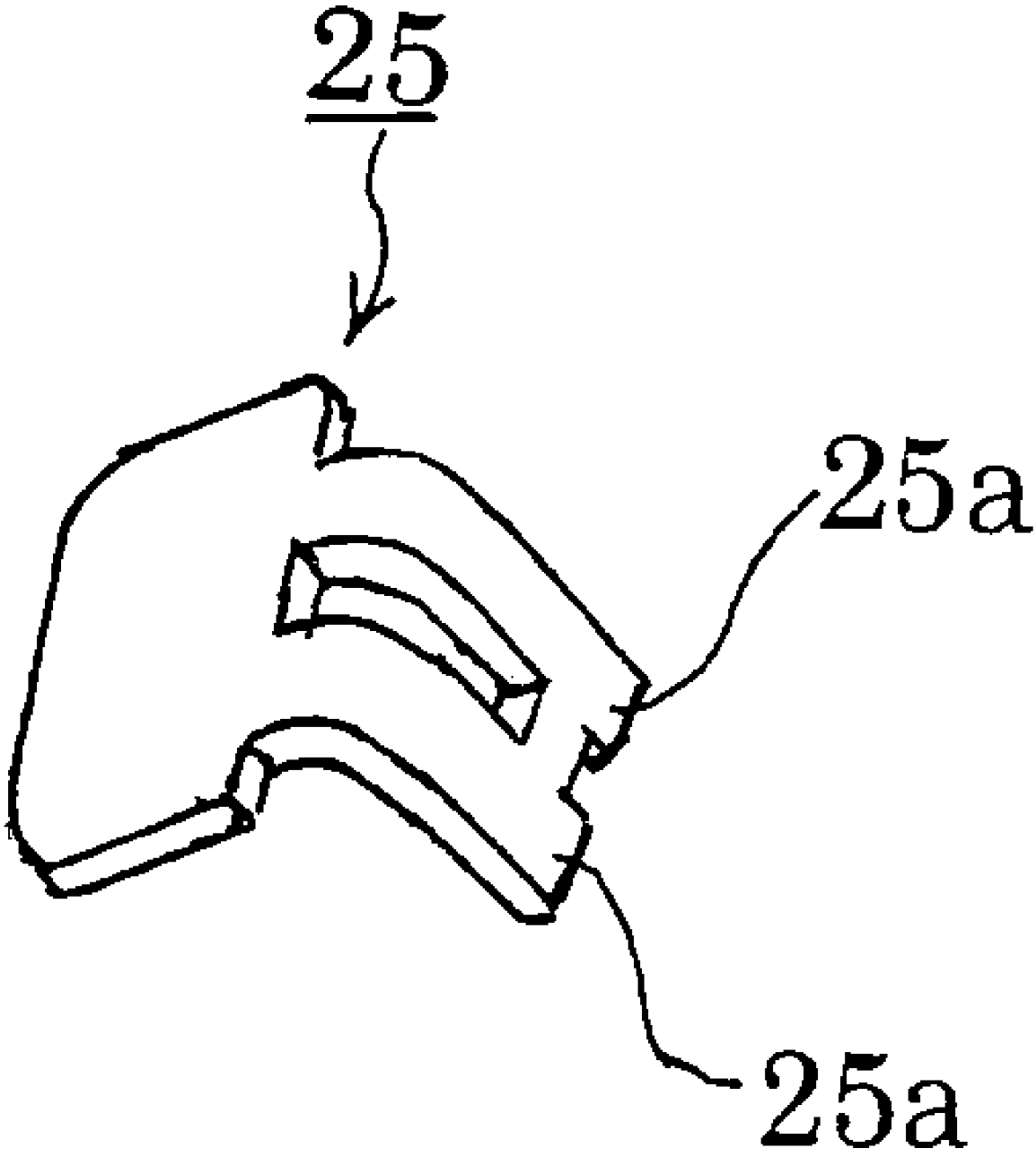
FIG. 10 is a perspective view of the armature.
Figure 11:
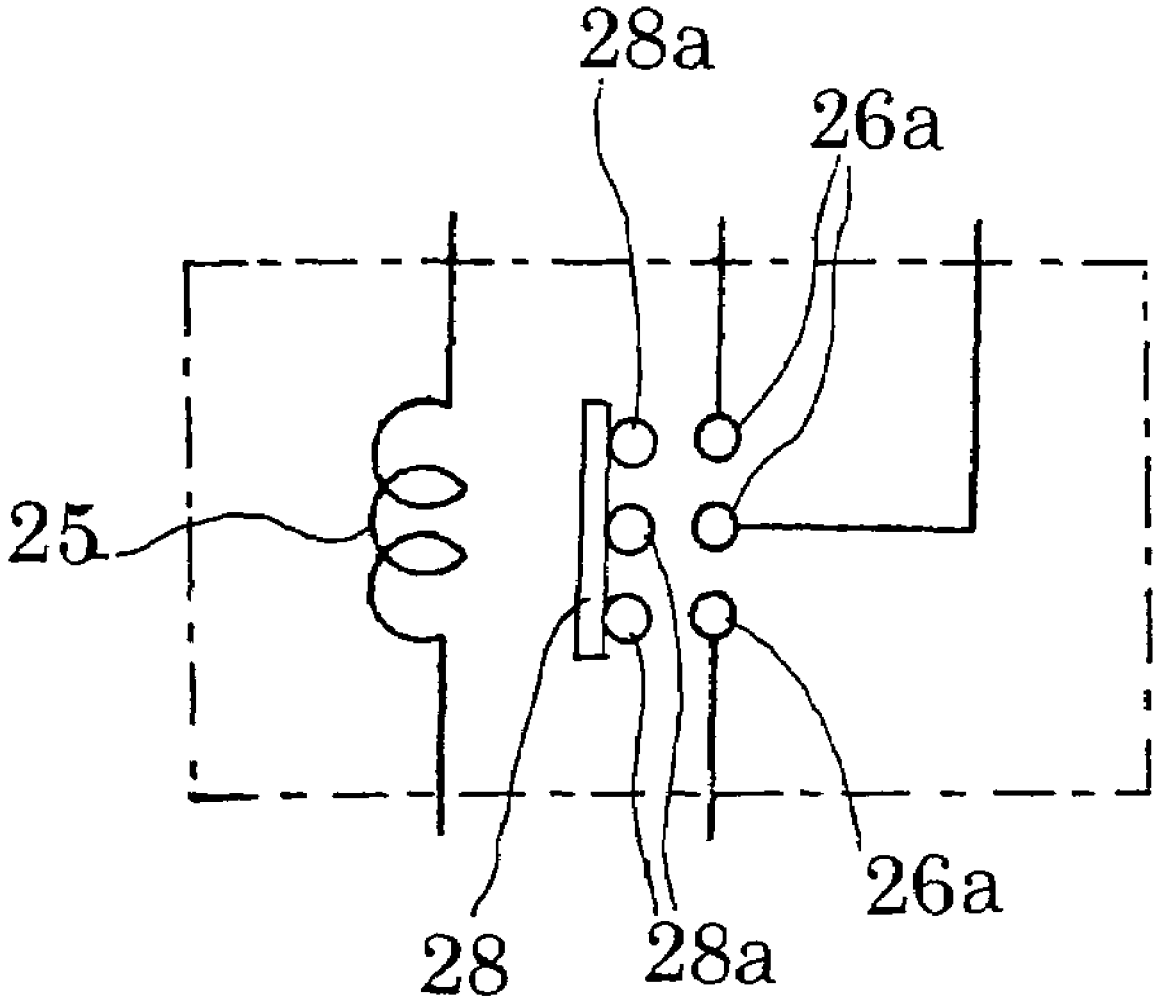
FIG. 11 is a schematic circuit diagram of electromagnetic relay with one-circuit three-contact gap.
Figure 12:
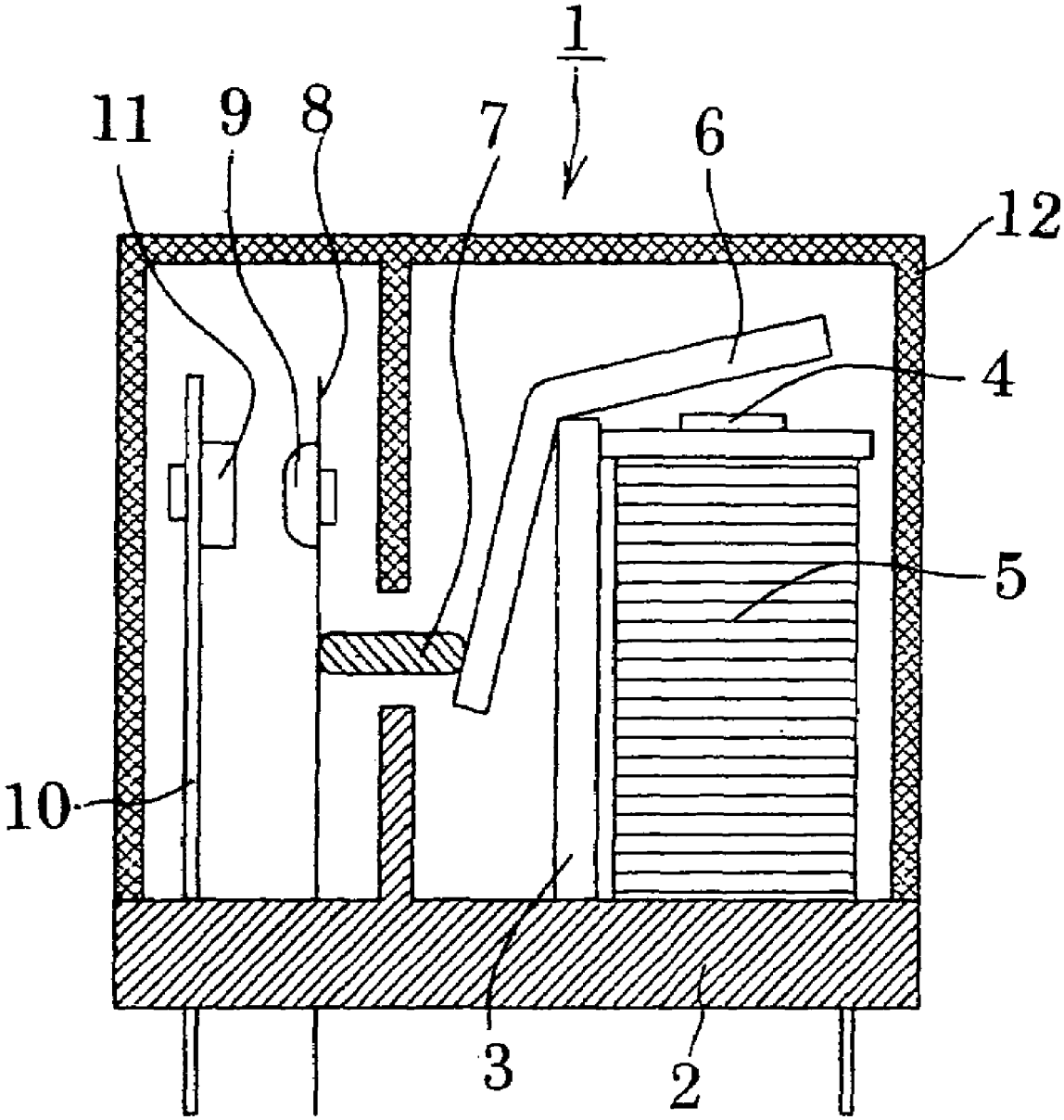
FIG. 12 (Prior Art)
FIG. 12 is a cross section of a conventional electromagnetic relay.

As shown in FIG. 9, with its right-end section being supported by the height 32 which is made near the center on the insulated base 21, the elastic plate 29, shown in FIG. 7 and FIG. 8, with the supported section as the revolution start point revolves, making elastic transformation, following the pressure recovery action of the armature 25, and with this action, the moveable springs 27 also make elastic transformation with the flat sections 27*b*, illustrated in FIG. 5, of the moveable springs 27 moving up and down, thus causing the moveable contacts 28*a*, illustrated in FIG. 1, which are made on the moveable plate 28, which is fastened to the moveable springs 27 to connect or disconnect to the fixed contacts 26*a*.

And as for the moveable plate 28, it is recommendable to make it thicker than the moveable spring 27 in order to respond to large electric currents which go through the contacts and to produce it with copper or copper alloy which has low specific resistance. Onto the moveable plate 28, moveable contacts 28*a* are installed, and the installation method can be by calking or you can use the moveable plate 28 itself as the moveable contacts, and further, you can also stick the moveable contacts 28*a* to the moveable plate 28.

The elastic plate 29 is made like T-shape as shown in FIG. 7, and on the left-end of the straight line section 29*a*, which is the longitudinal portion of the elastic plate 29, the step section 29*b* is made downwards in the vertical direction in FIG. 7, and the side sections 29*c* are made vertically, as shown in the same figure, at the left-end section of the straight line section 29*a* which is an extension of the both side sections 29*c*. And at the right-end section of the same figure, a small hole 29*d* is made to join to the height 32 made on the insulation base 21.

As shown in FIG. 9, the elastic plate 29 joins the small hole 29*d* to the height 32, making the straight line section 29*a* and the both-side side sections 29*c* contact the upper surface of the moveable panel 28. The both-side side sections 29*c* are the sections which contact the end section 25*a* at both ends of the armature 25 and support the drive action of the armature 25. And the straight line section 29*a* is placed at a position where the fixed contact 26*a* positioned in the center of the apex of a triangle-shape and the moveable contact 28*a* contact each other, and the side sections 29*c* on both sides are placed in a position where fixed contacts 26*a* positioned like a straight line on the left and right sides of the front end of the insulation base 21 and their corresponding moveable contacts 28*a* contact each other. Thus, when the elastic plate 29 revolves with the height 32 as the revolution starting point due to the move of the armature 25, the elastic plate 29 lowers the moveable plate 28 against the pressure of the moveable springs 27 via the step section 29*b* while causing deflection, and as it is structured so that each of the fixed contacts 26*a* at each apex of the triangle shape can connect to each of the corresponding moveable contacts 28*a* simultaneously and elastically, so the performance of the electromagnetic relay with the one-circuit three-contact gap can be efficiently improved.

This invention can be modified in various ways as long as the essence of it remains unchanged, so the scope of this invention naturally extends even to electromagnetic relays produced with such modifications, not limited to the above example.

What is claimed is:

1. In an electromagnetic relay which has the electromagnetic drive section, which consists of coil, iron core, yoke and armature and fixed contacts and moveable contacts which are designed to open or close in response to the drive action of the electromagnetic drive section, each of the fixed contacts is respectively installed on a fixed terminal No. 1, 2 and 3, which are installed on the upper surface of the insulation base as if joining it, and is positioned at the apex of an approximate triangle on the upper surface of an insulation base, and each of the moveable contacts is installed on the lower surface of a moveable plate and is installed at a position to correspond to each of the fixed contacts, and the moveable plate is fastened to a moveable spring whose both ends are held onto the left-right sides of the insulation base and is structured to move at a specified distance from the fixed contacts due to the pressure of the moveable spring, and on the upper surface of the moveable plate, an elastic plate is installed with its one end being held by a height pin formed in the insulation base at a predetermined height, and the elastic plate has a step section in the center with the step section being positioned to contact the center of the approximate triangle connecting three contact positions of the contacts of the moveable plate, and side sections on both sides of the elastic plate, which contact the end of the armature are formed, and the drive action of the armature lowers the moveable plate against the pressure of the moveable spring, thus causing deflection to the elastic plate to connect each of the fixed contacts to each of the corresponding moveable contacts at the three contact points with uniform contact strength.

2. An electromagnetic relay comprising:

a base;

an electromagnetic drive section having a coil, core, yoke and an armature;

three fixed contacts provided at positions that generally form a triangle on an upper surface of said base;

a movable plate having three movable contacts provided at positions corresponding to said three fixed contacts;

a movable spring attached to said movable plate, said movable spring having both ends supported by said base;

an elastic plate comprising a straight section having a step formed therein, wherein the step is positioned to contact said movable plate at a position substantially in the center of a triangle formed by the three movable contacts formed on said movable pate; and positioning means, formed in one end of the straight section of said elastic plate and on said base, for holding said elastic plate in position at a predetermined height, whereby when the armature moves causing contact with said elastic plate, said movable plate moves against said movable spring resulting in the three movable contacts contacting said three fixed contacts with uniform contact strength.

3. An electromagnetic relay as in claim 2 wherein:

said elastic plate further comprises laterally extending side sections, wherein said armature contacts the laterally extending side sections.

4. An electromagnetic relay as in claim 2 wherein:

said elastic plate comprises a T-shape.

5. An electromagnetic relay as in claim 2 wherein:

said positioning means comprises a hole formed in one end of the straight section of said elastic plate and a height pin form on said base.

6. An electromagnetic relay comprising:

an insulation base;

an electromagnetic drive section having a coil, core, yoke and an armature having two separated contact end sections;

three fixed contacts provided at positions that generally form a triangle on an upper surface of said base;

a movable plate having three movable contacts provided at positions corresponding to said three fixed contacts;

a first movable spring attached to said movable plate adjacent to one end, said first movable spring having both ends supported by said base;

a second movable spring attached to said movable plate adjacent to another end, said second movable spring having both ends supported by said base;

an elastic plate comprising a straight section having a step formed therein intermediate either end, a hole formed in one end, and two opposing lateral side sections adjacent the distal end, wherein the step is positioned to contact said movable plate at a position substantially in the center of a triangle formed by the three movable contacts formed on said movable pate; and a height pin formed in said insulation base, said height pin adapted to receive the hole formed in one end of said elastic plate, whereby said elastic plate is held in position at a predetermined height, whereby when the armature moves a respective one of the two separated contact end sections of the armature contact a respective one of the two opposing lateral side sections of the elastic plate causing the step formed therein to contact said movable plate causing it to move against said movable spring resulting in the three movable contacts contacting said three fixed contacts with uniform contact strength.

* * * * *